US008581486B2

(12) United States Patent
Liu et al.

(10) Patent No.: US 8,581,486 B2
(45) Date of Patent: Nov. 12, 2013

(54) FIELD EMISSION DEVICE AND FIELD EMISSION DISPLAY

(75) Inventors: Peng Liu, Beijing (CN); Duan-Liang Zhou, Beijing (CN); Pi-Jin Chen, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 170 days.

(21) Appl. No.: 13/151,458

(22) Filed: Jun. 2, 2011

(65) Prior Publication Data

US 2012/0169209 A1 Jul. 5, 2012

(30) Foreign Application Priority Data

Dec. 31, 2010 (CN) ..... 2010 1 0618382

(51) Int. Cl.
*H01J 9/02* (2006.01)

(52) U.S. Cl.
USPC ..... 313/498; 313/495; 313/310

(58) Field of Classification Search
None
See application file for complete search history.

(56) References Cited

U.S. PATENT DOCUMENTS

| | | | | |
|---|---|---|---|---|
| 5,945,777 | A * | 8/1999 | Janning et al. | 313/310 |
| 6,036,565 | A * | 3/2000 | Seko et al. | 445/24 |
| 7,187,112 | B2 * | 3/2007 | Nakamoto | 313/311 |
| 7,741,768 | B2 * | 6/2010 | Wei et al. | 313/497 |
| 7,768,181 | B2 * | 8/2010 | Baik et al. | 313/103 R |
| 7,780,496 | B2 * | 8/2010 | Liu et al. | 445/50 |
| 7,915,800 | B2 * | 3/2011 | Kim et al. | 313/497 |
| 8,283,861 | B2 * | 10/2012 | Liu et al. | 313/506 |
| 8,339,027 | B2 * | 12/2012 | Liu et al. | 313/495 |
| 2006/0163994 | A1 * | 7/2006 | Damen | 313/309 |
| 2007/0063629 | A1 * | 3/2007 | Tuck | 313/311 |
| 2009/0239072 | A1 * | 9/2009 | Wei et al. | 428/402 |
| 2012/0169222 | A1 * | 7/2012 | Liu et al. | 313/506 |

FOREIGN PATENT DOCUMENTS

| | | |
|---|---|---|
| JP | 64-33833 | 2/1989 |
| JP | 2001-52598 | 2/2001 |

OTHER PUBLICATIONS

Chin Li Cheung, Growth of single-walled Carbon nanotubes on the given Locations for AFM Tips,Appl. Phys. Lett.,May 22, 2000,3136-3138,vo1. 76,American.

* cited by examiner

*Primary Examiner* — Britt D Hanley
(74) *Attorney, Agent, or Firm* — Altis & Wispro Law Group, Inc.

(57) ABSTRACT

The present disclosure provides a field emission device. The field emission device includes an insulating substrate having a first surface, a first electrode, a second electrode, at least one cathode emitter and a secondary electron emitter. The first electrode and the second electrode are spaced from each other and are located on the first surface of the insulating substrate. The cathode emitter is electrically connected to the first electrode and spaced from the second electrode. A secondary electron emitter is spaced from the cathode emitter. The secondary electron emitter has an electron emitting surface exposed to the cathode emitter. A secondary electron emitter is spaced from the cathode emitter. The cathode emitter is oriented toward the secondary electron emitter.

15 Claims, 11 Drawing Sheets

FIELD EMISSION DEVICE AND FIELD EMISSION DISPLAY

CROSS-REFERENCE TO RELATED APPLICATIONS

This application claims all benefits accruing under 35 U.S.C. §119 from China Patent Application No. 201010618382.6, filed on Dec. 31, 2010 in the China Intellectual Property Office, disclosure of which is incorporated herein by reference.

BACKGROUND

1. Technical Field

The present disclosure relates to a field emission device and a field emission display.

2. Description of Related Art

Field emission devices provide many advantages such as low power consumption, fast response speed, and high resolution. Therefore, they are being actively developed.

A field emission device is reported in an article by Chin Li Cheung, entitled "Growth of single-walled Carbon nanotubes on the given Locations for AFM Tips", Chin Li Cheung, Appl. Phys. Lett., Vol. 76, No. 21, May 22, 2000. The field emission device includes a conductive base and a single carbon nanotube. One end of the carbon nanotube is connected to the conductive base. Another end of the carbon nanotube is used as a field emission portion. In use, a voltage is applied to the field emission device. A number of electrons are emitted from the carbon nanotubes. However, a high positive voltage is needed and the field emission current is low because the electron emission characteristic of the carbon nanotubes needs to be improved. The lifespan of the field emission device is short. The field emission display using the field emission device has similar problems.

What is needed, therefore, is a field emission device and a field emission display having large field emission current and low voltage.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present field emission device and field emission display.

Figure 1:
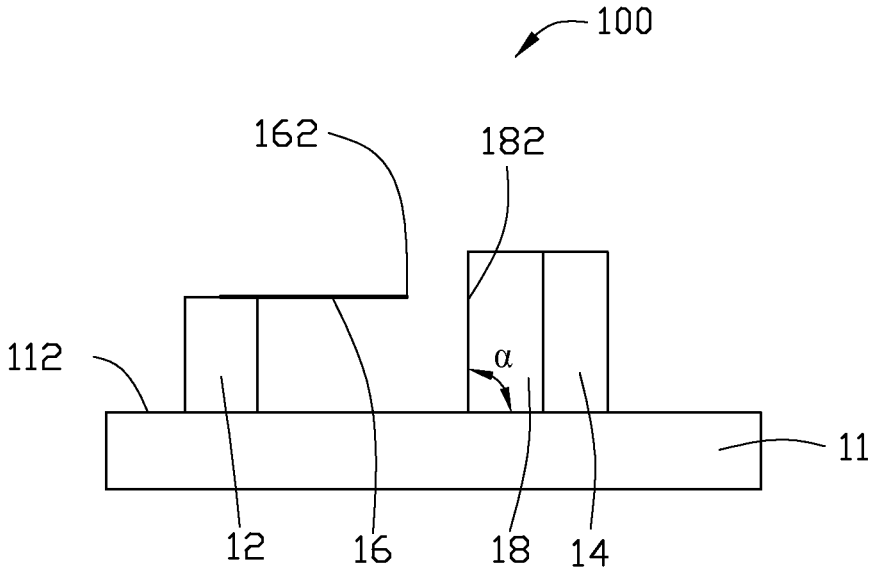
FIG. 1 is a cross-sectional view of one embodiment of a field emission unit.
Figure 2:
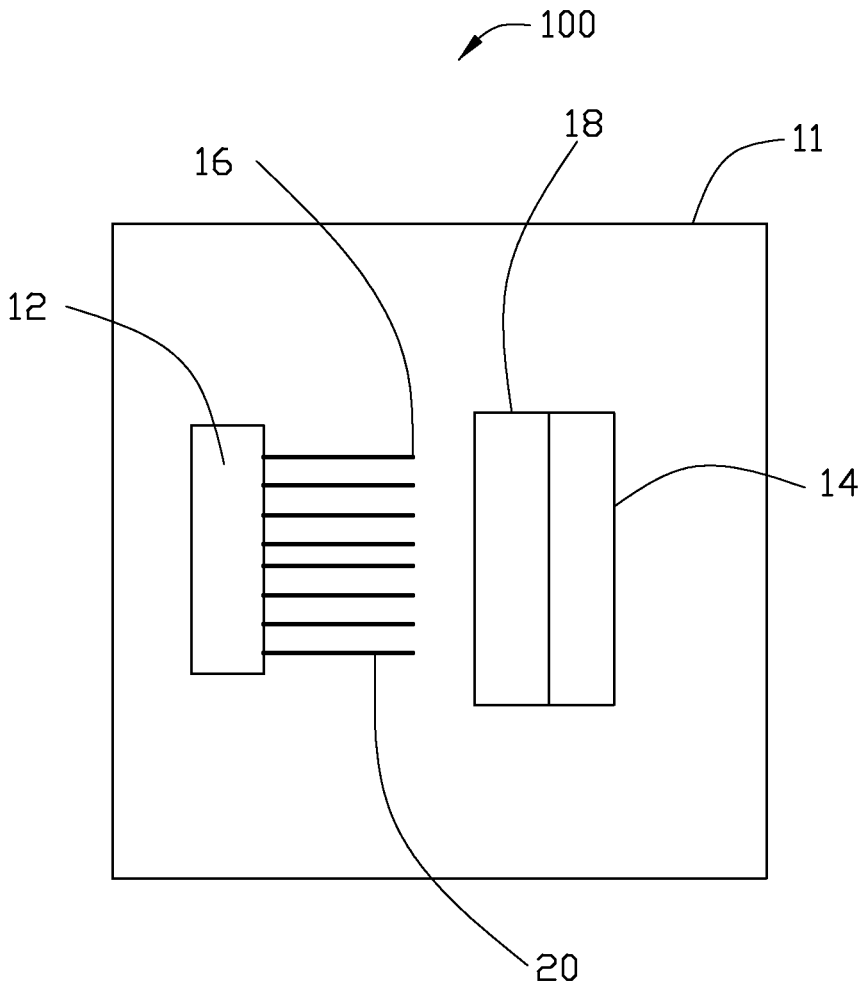
FIG. 2 is a top view of the field emission unit of FIG. 1.

Referring to FIG. 1 and FIG. 2, a field emission unit 100 of one embodiment is shown. The field emission unit 100 includes an insulating substrate 11, a first electrode 12, a second electrode 14, at least one cathode emitter 16, and a secondary electron emitter 18. The first electrode 12 and the second electrode 14 are spaced from each other and located on a top surface 112 of the insulating substrate 11. The cathode emitter 16 is electrically connected to the first electrode 12 and is spaced from the second electrode 14. At least a portion of the secondary electron emitter 18 is located between the first electrode 12 and the second electrode 14. The cathode emitter 16 is spaced from and is oriented toward the secondary electron emitter 18.

The insulating substrate 11 supports the first electrode 12, the second electrode 14, and other elements located on the insulating substrate 11. The insulating substrate 11 can be made of resin, glass, silicon dioxide, ceramic, or other insulating materials. The thickness and the size of the insulating substrate 11 can be selected according to need. In one embodiment, the insulating substrate 11 is made of glass.

The shapes of the first electrode 12 and the second electrode 14 can be selected according to need (e.g. cube, cuboid, or cylinder). The first electrode 12 and the second electrode 14 may be made of conductive material such as copper, aluminum, gold, silver, indium tin oxide, conductive slurry or a combination thereof. In one embodiment, the first electrode 12 and the second electrode 14 are made of conductive slurry.

The cathode emitter 16 is substantially perpendicularly located on a top surface of the first electrode 12 away from the insulating substrate 11. The cathode emitter 16 is electrically connected to the first electrode 12 by conductive adhesive, intermolecular forces or other ways, for example a flocking process or applying one-by-one. The cathode emitter 16 may be linear. The cathode emitter 16 may be silicon wire, carbon nanotubes, carbon fiber, or carbon nanotube wire. The cathode emitter 16 is substantially parallel to the top surface 112 of the insulating substrate 11 and spaced from the insulating substrate 11 by the first electrode 12. A first end of the cathode emitter 16 is electrically connected to the first electrode 12 and a second end of the cathode emitter 16 extends toward the second electrode 14. The second end of the cathode emitter 16 is configured as a field emission portion 162. The field emission portion 162 is away from the first electrode 12. The second end of the cathode emitter 16 also extends to the secondary electron emitter 18. In one embodiment, the cathode emitter 16 includes a number of carbon nanotube wires. The carbon nanotube wires are substantially parallel to and spaced from each other. The carbon nanotube wires include a number of carbon nanotubes joined end-to-end by van der Waals force to form a free-standing structure. The length of each of the carbon nanotube wires is in a range from the 10 micrometers to 1000 micrometers. The distance between two adjacent carbon nanotube wires is in a range from 1 micrometer to 1000 micrometers.

In one embodiment, the secondary electron emitter 18 is located on the top surface 112 of the insulating substrate 11 and contacts a flank of the second electrode 14. The shape of the secondary electron emitter 18 has no limitation. The secondary electron emitter 18 can emit secondary electrons when electrons emitted by the cathode emitter 16 collide with the secondary electron emitter 18. The material of the secondary electron emitter 18 may be magnesium oxide (MgO), beryllium oxide (BeO), barium oxide (BaO), Cesium oxide ($Cs_2O$), calcium oxide (CaO), strontium oxide (SrO), or magnesium fluoride ($MgF_2$).

The secondary electron emitter 18 may have an electron emitting surface 182 facing to the cathode emitter 16. An angle $\alpha$ (shown in FIG. 3) defined between the electron emitting surface 182 and the top surface 112 is in a range from about 0 degrees to about 90 degrees. In one embodiment, the angle $\alpha$ is in a range from about 30 degrees to about 60 degrees. In one embodiment, the electron emitting surface 182 is substantially perpendicular to the top surface 112 of the insulating substrate 11. An angle $\beta$ (shown in FIG.3) is defined by the electron emitting surface 182 and the field emission emitter 16, is in a range from 90 degrees to 180 degrees. In one embodiment, the angle $\beta$ is in a range from about 120 degrees to about 150 degrees. The electron emitting surface 182 may be a plane surface or a curved surface.

In use, a voltage can be applied between the first electrode 12 and the second electrode 14. An electric field is formed between the first electrode 12 and the second electrode 14. The cathode emitter 16 emits a number of first electrons under the electric field, and the initial electrons fly to the second electrode 14. The initial electrons collide with the secondary electron emitter 18. The secondary electron emitter 18 emits secondary electrons because of the collision of the initial electrons. The number of the secondary electrons is more than the number of the initial electrons. Therefore, the secondary electron emitter 18 amplifies the electric current, which is formed by the initial electrons, and a large field emission current is obtained.

Figure 3:
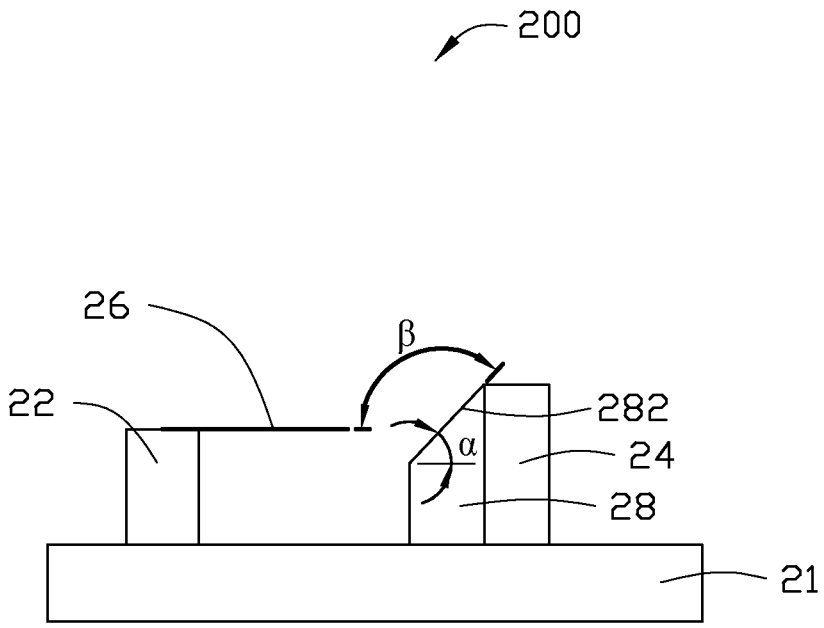
FIG. 3 is a cross-sectional view of one embodiment of a field emission unit.

Referring to FIG. 3, a field emission unit 200 of one embodiment is shown. The field emission unit 200 includes an insulating substrate 21, a first electrode 22, a second electrode 24, at least one cathode emitter 26, and a secondary electron emitter 28. The secondary electron emitter 28 has an electron emitting surface 282. The angle $\alpha$ defined between the electron emitting surface 282 and the top surface 212 is 45 degrees. As a result, the effective electron emitting surface 282 of the secondary electron emitter 28 is enlarged so that the field emission current is amplified.

Figure 4:
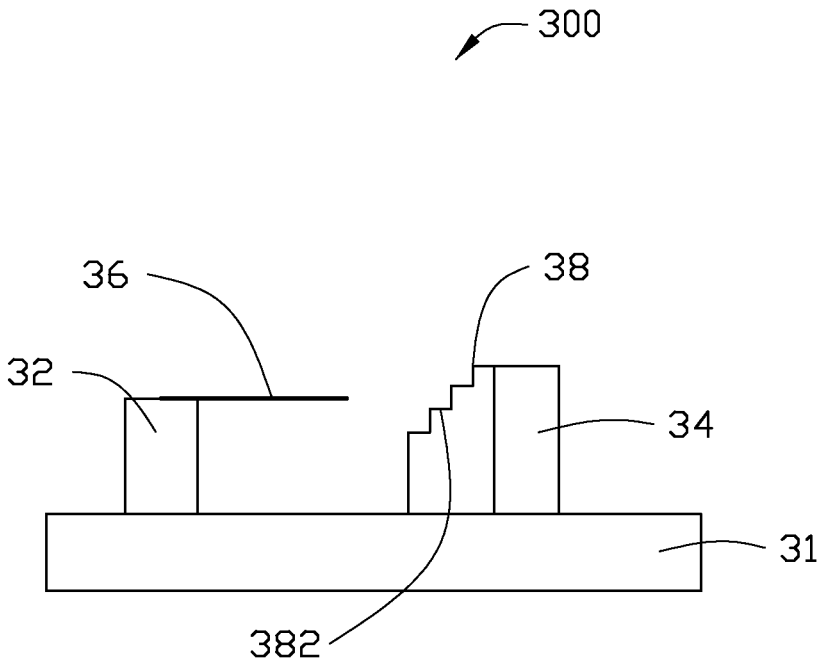
FIG. 4 is a cross-sectional view of one embodiment of a field emission unit.

Referring to FIG. 4, a field emission unit 300 of one embodiment is shown. The field emission unit 300 includes an insulating substrate 31, a first electrode 32, a second electrode 34, at least one cathode emitter 36 and a secondary electron emitter 38. The secondary electron emitter 38 has an electron emitting surface 382. The field emission unit 300 is similar to the field emission unit 100. The electron emitting surface 382 has a stepped configuration. As a result, the effective area of the electron emitting surface 382 of the secondary electron emitter 38 is enlarged so that the field emission current is amplified.

Figure 5:
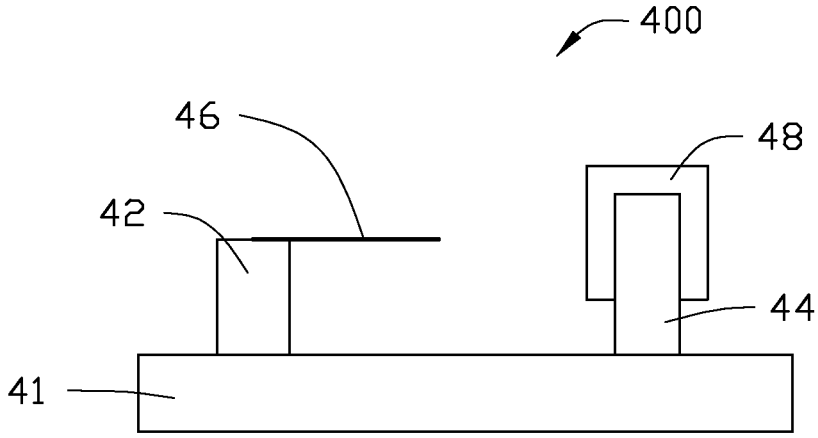
FIG. 5 is a cross-sectional view of one embodiment of a field emission unit.

Referring to FIG. 5, a field emission unit 400 of one embodiment is shown. The field emission unit 400 includes an insulating substrate 41, a first electrode 42, a second electrode 44, at least one cathode emitter 46 and a secondary electron emitter 48. The secondary electron emitter 48 encloses a top surface of the second electrode 44.

Figure 6:
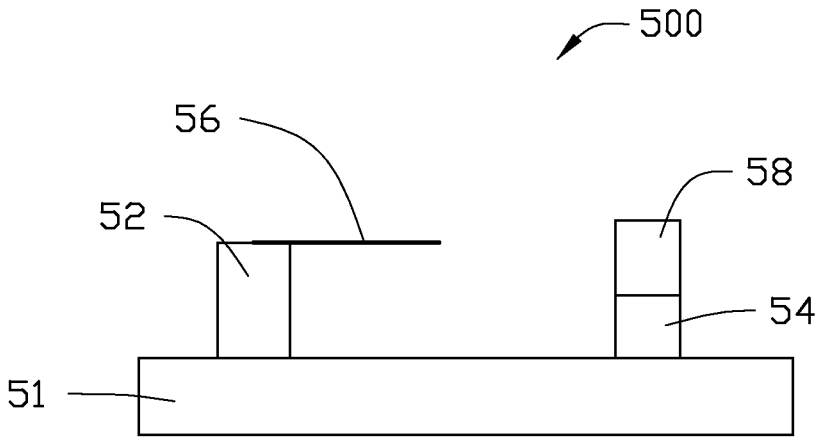
FIG. 6 is a cross-sectional view of one embodiment of a field emission unit.

Referring to FIG. 6, a field emission unit 500 of one embodiment is shown. The field emission unit 500 includes an insulating substrate 51, a first electrode 52, a second electrode 54, at least one cathode emitter 56 and a secondary electron emitter 58. The secondary electron emitter 58 is located on a top surface of the second electrode 54 away from the insulating substrate 51.

Figure 7:
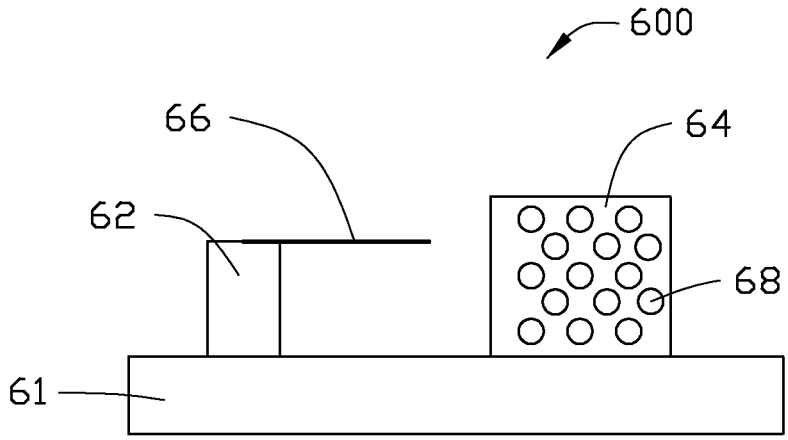
FIG. 7 is a cross-sectional view of one embodiment of a field emission unit.

Referring to FIG. 7, a field emission unit 600 of one embodiment is shown. The field emission unit 600 includes an insulating substrate 61, a first electrode 62, a second electrode 64, at least one cathode emitter 66 and a secondary electron emitter 68. Both of the second electrode 64 and the secondary electron emitter 68 are in powder form. The second electrode 64, the secondary electron emitter 68 ang adhesion agent are mixed with each other to form a composite. The second electron emitter 68 is in powder form and dispersed in the second electrode 64.

Figure 8:
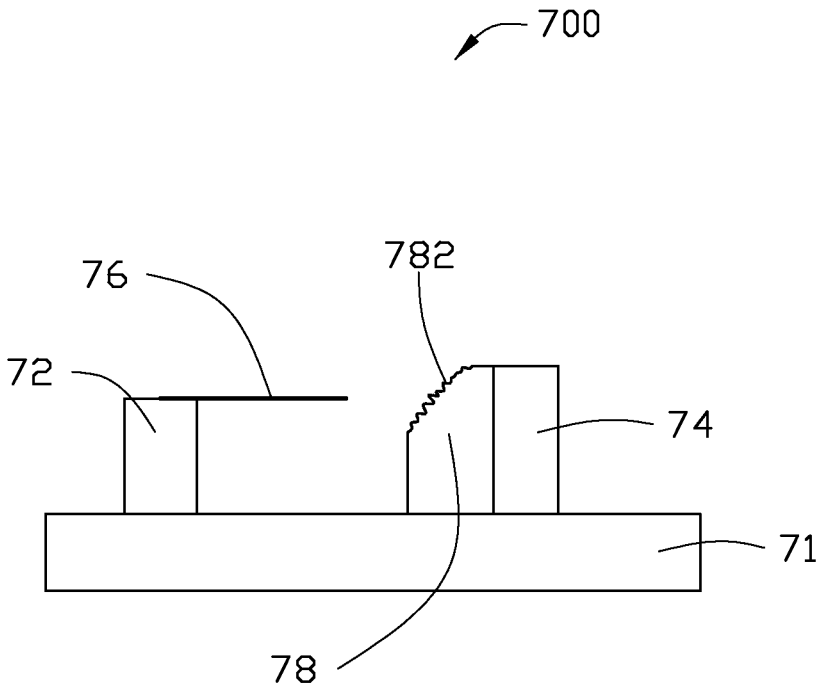
FIG. 8 is a cross-sectional view of one embodiment of a field emission unit.
Figure 9:
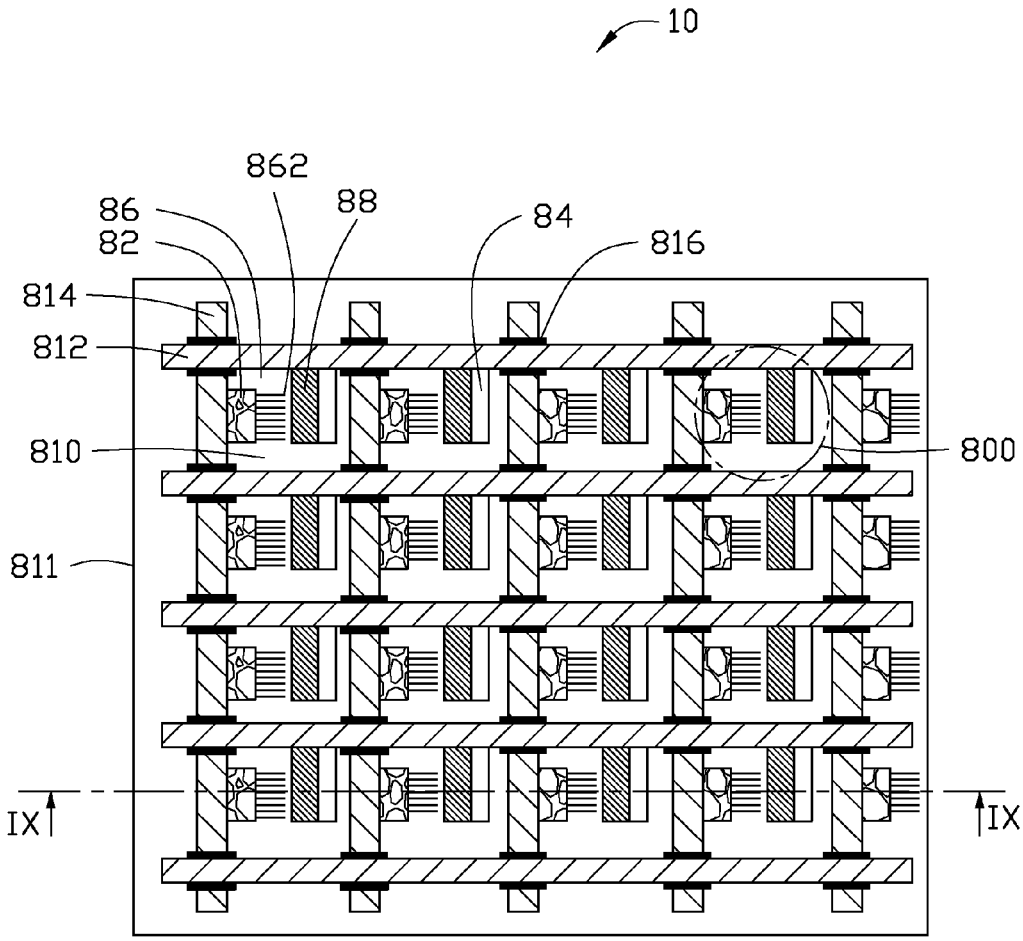
FIG. 9 is a top view of one embodiment of a field emission device.
Figure 10:
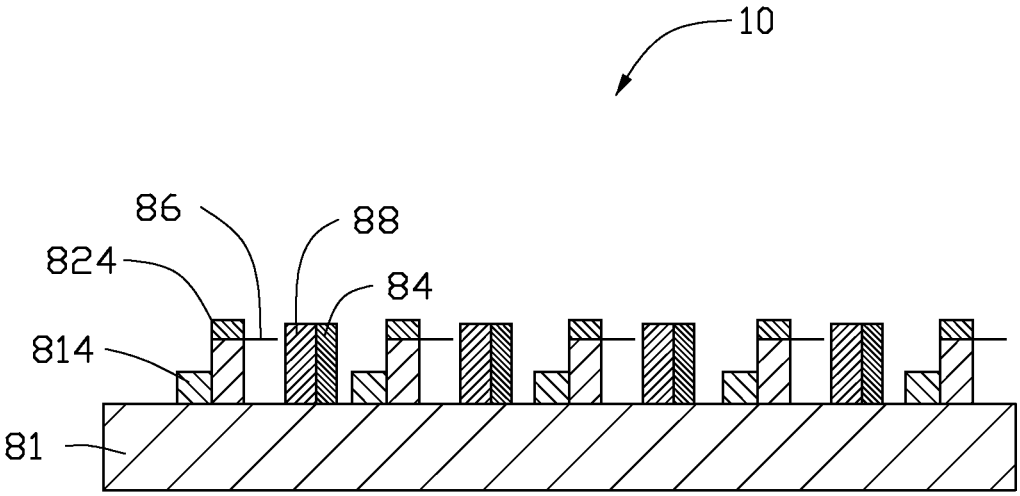
FIG. 10 is a cross-sectional view of the field emission device of FIG. 8, alone line IX-IX.

Referring to FIG. 8, a field emission unit 700 of one embodiment is shown. The field emission unit 700 includes an insulating substrate 71, a first electrode 72, a second electrode 74, at least one cathode emitter 76 and a secondary electron emitter 78. The secondary electron emitter 78 surface is pitted. It is understood that the secondary electron emitter 78 surface can also be smooth Referring to FIG. 9 and FIG. 10, a field emission device 10 of one embodiment is shown. The field emission device 10 includes a number of electron emitting units 800, a number of row electrodes 812, a number of line electrodes 814 and a number of insulators 816. Each of the electron emitting units 800 includes a first electrode 82, a second electrode 84, at least one cathode emitter 86 and a secondary electron emitter 88. The electron emitting units 800 share one insulating substrate 81. The row electrodes 812 are located on the insulating substrate 81. The row electrodes 812 are spaced from and parallel to each other. The line electrodes 814 are located on the insulating substrate 81. The line electrodes 814 are spaced from and parallel to each other. The row electrodes 812 are substantially perpendicular to and cross the line electrodes 814. The insulators 816 are located at the intersections of the row electrode 812 and the line electrode 814 for providing electrical insulation between the row electrodes 812 and the line electrodes 814. Each two adjacent row electrodes 812 and line electrodes 814 form a cell 810. One electron emitting unit 800 is located in each cell 810.

The insulating substrate 81 is an insulating board. Material of the insulating substrate 81 is, for example, ceramics, glass, resins or quartz. In addition, a size and a thickness of the insulating substrate 81 can be chosen according to need. In this embodiment, the insulating substrate 81 is a glass substrate with a thickness of more than 1 millimeter.

In one embodiment, the row electrodes 812 and the line electrodes 814 are made of conductive material, for example, metal. In practice, the row electrodes 812 and the line electrodes 814 are formed by applying conductive slurry on the insulating substrate 81 using a printing process, e.g. silk-screen printing process. The conductive slurry composed of metal powder, glass powder, and binder. For example, the metal powder can be silver powder and the binder can be terpineol or ethyl cellulose (EC). Particularly, the conductive slurry includes 50% to 90% (by weight) of the metal powder, 2% to 10% (by weight) of the low-melting glass powder, and 8% to 40% (by weight) of the binder. In one embodiment, each of the row electrodes 812 and the line electrodes 814 is formed with a length ranging from about 20 micrometers to about 1.5 centimeters, a width ranging from about 30 micrometers to about 100 micrometers and with a thickness ranging from about 10 micrometers to about 500 micrometers. However, it is noted that dimensions of each of the row electrodes 812 and the line electrodes 814 can vary corresponding to dimension of each cell 810. In another embodiment, each of the row electrodes 812 and the line electrodes 814 is formed with a length ranging from about 100 micrometers to about 800 micrometers, a width ranging from about 50 micrometers to about 500 micrometers and with a thickness ranging from about 20 micrometers to about 100 micrometers.

The first electrode 82 is electrically connected to the row electrodes 812. The second electrode 84 is electrically connected to the line electrodes 814. The cathode emitters 86 are located on a top surface of the insulating substrate 81. Moreover, the cathode emitters 86 are located over the insulating substrate 81 in one embodiment. There is a space between the cathode emitters 86 and the insulating substrate 81. The space is configured to enhance the field emission abilities of the cathode emitters 86. The electron emitting unit 800 can be used as the electron emitting unit 100, 200, 300, 400, 500, 600 described above.

The size of the first electrode 82 and the second electrodes 84 is selected according to need. In one embodiment, each of the first electrode 82 and the second electrodes 84 has a length ranging from 20 micrometers to 1.5 centimeters, a width ranging from 30 micrometers to 1 cm and a thickness ranging from 10 micrometers to 500 micrometers. Each of the first electrode 82 and the second electrode 84 has a length ranging from 100 micrometers to 800 micrometers, a width ranging from 50 micrometers to 500 micrometers and a thickness ranging from 20 micrometers to 100 micrometers. In addition, the first electrode 82 and the second electrode 84 of the present embodiment are formed by printing the conductive slurry on the insulating substrate 81. As mentioned above, the conductive slurry forming the first electrode 82 and the second electrode 84 is the same as the row electrodes 812 and line electrodes 814.

Figure 11:
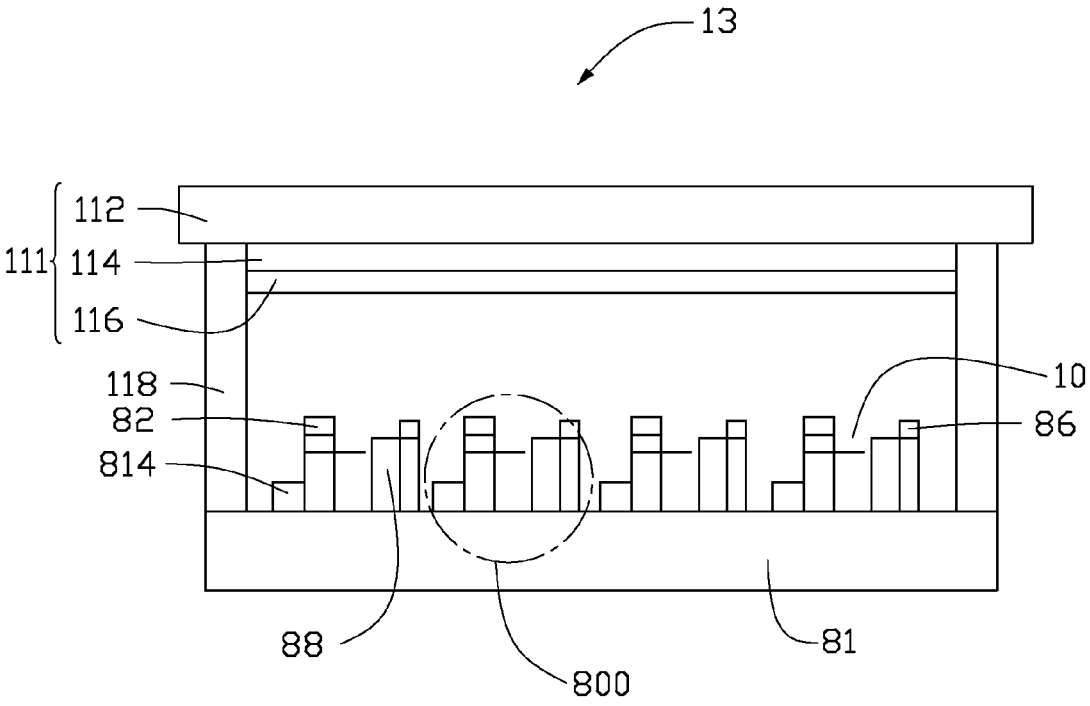
FIG. 11 is a cross-sectional view of one embodiment of a field emission display.

Further referring to FIG. 11, a field emission display 13 of one embodiment is provided. The field emission display 13 includes a field emission device 10 and an anode structure 111 spaced from the field emission device 10.

The anode structure 111 includes a glass substrate 112, a transparent anode 114, and a phosphor layer 116. The transparent anode 114 is mounted on the glass substrate 112. The transparent anode 114 can be ITO film, zinc oxide (ZnO) film, carbon nanotube film, or graphene film. The phosphor layers 116 are coated on the transparent anode 114 and spaced corresponding to the locations of the field emission units 800. An insulated spacer 118 is located between the anode structure 111 and the insulating substrate 81 of the field emission device 10 to maintain a vacuum. Each of the secondary electron emitters of one field emission unit 800 is corresponding to one of the phosphor layers 116. In addition, a first focus electrode 82 can be located on the first electrode and a second focus electrode 86 can be located on the second electrode. The first focus electrode 82 and the second focus electrode 86 can be used to focus the electrons to the anode structure 111.

In operation, different voltages are applied to the row electrodes, the line electrodes 814, and the anode electrode 114. The field emission unit 800 emits initial electrons under the voltage between the row electrodes 812, the line electrodes 814. Finally, the electrons reach the anode electrode 114 under the electric field induced by the anode electrode 114 and collide with the fluorescent layer 117 located on the anode electrode 114. The fluorescent layer 117 then emit visible light to accomplish display function of the field emission display 13. Field emission currents at different cathode emitters can be easily modulated by selectively changing the voltages of the row electrodes and the line electrodes 814.

The field emission device and the field emission display described-above have the following benefits: first, the field emission device and the field emission display can have a large field emission current by the secondary electron emitter. Second, the voltage applied to the first electrode and second electrode can be reduced, therefore, the life span of the field emission device and the field emission display is enhanced.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A field emission device comprising:
an insulating substrate having a first surface;
a first electrode located on the first surface;
a second electrode located on the first surface and spaced from the first electrode;
a cathode emitter electrically connected to the first electrode;
a secondary electron emitter spaced from the cathode emitter and having an electron emitting surface, the cathode emitter being oriented toward the secondary electron emitter, wherein the electron emitting surface has a stepped configuration comprising a plurality of steps.

2. The field emission device of claim 1, wherein the cathode emitter is linear, the cathode emitter comprises of a material that is selected from the group consisting of silicon wire, carbon nanotubes, carbon fiber or carbon nanotube wire.

3. The field emission device of claim 2, wherein the cathode emitter is substantially parallel to the first surface.

4. The field emission device of claim 1, wherein at least a portion of the secondary electron emitter is located between the first electrode and the second electrode.

5. The field emission device of claim 1, wherein the secondary electron emitter is located on the first surface of the insulating substrate and spaced from the first electrode.

6. The field emission device of claim 1, wherein the secondary electron emitter is located on a top surface or a flank of the second electrode.

7. The field emission device of claim 1, wherein the secondary electron emitter encloses a top surface of the second electrode.

8. The field emission device of claim 1, wherein the electron emitting surface is pitted.

9. The field emission device of claim 1, wherein the second electrode, which is in powder form, the secondary electron emitter, which is in powder form, and adhesion agent form a composite.

10. The field emission device of claim 9, wherein the secondary electron emitter is dispersed in the second electrode.

11. The field emission device of claim 1, wherein a material of the secondary electron emitter is selected from the group consisting of magnesium oxide, beryllium oxide, barium oxide, cesium oxide, calcium oxide, strontium oxide or magnesium fluoride.

12. A field emission device comprising:
an insulating substrate;
a plurality of row electrodes located on the insulating substrate, spaced from and parallel to each other;

a plurality of line electrodes located on the insulating substrate, spaced from and parallel to each other, wherein the plurality of row electrodes are set an angle relative to the plurality of line electrodes to form a plurality of cells;

a plurality of electron emitting units, wherein each of the plurality of electron emitting units is located in one of the plurality of cells and comprises:

a first electrode;

a second electrode;

a cathode emitter; and a secondary electron emitter spaced from the cathode emitter and having an electron emitting surface, the cathode emitter being oriented toward the secondary electron emitter, wherein the electron emitting surface has a stepped configuration comprising a plurality of steps.

13. A field emission display comprising:

a field emission device; and an anode structure spaced from the field emission device, wherein the field emission device comprising:

an insulating substrate;

a plurality of row electrodes located on the insulating substrate, spaced from and parallel to each other;

a plurality of line electrodes located on the insulating substrate, spaced from and parallel to each other, wherein the plurality of row electrodes are set an angle relative to the plurality of line electrodes to form a plurality of cells;

a plurality of electron emitting units, wherein each of the plurality of electron emitting units is located in one of the plurality of cells and comprises:

a first electrode;

a second electrode;

a cathode emitter; and a secondary electron emitter spaced from the cathode emitter and having an electron emitting surface, the cathode emitter being oriented toward the secondary electron emitter, wherein the electron emitting surface has a stepped configuration comprising a plurality of steps;

a first focus electrode located on the first electrode;

a second focus electrode located on the second electrode.

14. The field emission display of claim 13, wherein the anode structure comprises a substrate made of glass, a transparent anode, and a phosphor layer, a material of the transparent anode being selected from the group consisting of ITO film, zinc oxide film, carbon nanotube film, or graphene film.

15. The field emission device of claim 12, wherein the plurality of steps is stacked on a surface of the second electrode, the surface of the second electrode faces to the cathode emitter.

* * * * *